United States Patent [19]

Morimoto

[11] 4,094,055

[45] June 13, 1978

[54] AUTOMATIC WORKING METHOD OF CASTINGS

[75] Inventor: Toshiki Morimoto, Kawasaki, Japan

[73] Assignee: Mitsui Mining and Smelting Co., Ltd., Tokyo, Japan

[21] Appl. No.: 782,367

[22] Filed: Mar. 29, 1977

[51] Int. Cl.[2] ..... B22D 17/32

[52] U.S. Cl. ..... 29/527.6; 164/154; 164/76; 364/478

[58] Field of Search ..... 29/527.6; 164/154, 72, 164/131, 119, 344, 76, 270

[56] References Cited

U.S. PATENT DOCUMENTS

| | | | |
|---|---|---|---|
| 3,525,382 | 8/1970 | Devol | 164/154 |
| 3,951,202 | 4/1976 | Anderson | 164/154 |

*Primary Examiner*—Milton S. Mehr
*Attorney, Agent, or Firm*—Flynn & Frishauf

[57] ABSTRACT

An automatic working method of castings which comprises the steps of operating a die-casting machine to produce castings; operating a press to trim the castings; operating an industrial robot for carrying the castings from the die-casting machine to the press; operating an incasing device for successively supplying empty boxes to receive the castings; detecting the position of a casting set in the press; removing the casting from the press, in case the casting is improperly set; counting a number of castings delivered to the incasing device, and where the counted number is found to be smaller than a prescribed value, causing a deficient number of castings to be supplied to the incasing device; examining the operation of the machines undertaking the respective steps by a checking device attached to said machines; and, in case the operation of any of the machines is found to be defective, stopping said faulty machine.

15 Claims, 5 Drawing Figures

AUTOMATIC WORKING METHOD OF CASTINGS

BACKGROUND OF THE INVENTION

This invention relates to an automatic working method of castings which comprises the steps of producing castings by a die-casting machine; carrying the castings to a trimming press by means of an industrial robot; trimming the castings by the press; separating scrap or runner refuse from the trimmed castings; and finally removing the trimmed castings and scrap from the press.

Hitherto, castings produced by a casting machine have been manually supplied to a trimming press. However, manual handling of castings is accompanied with danger to an operator, and moreover the efficiency of said manual handling is subject to certain limitations.

To eliminate the above-mentioned drawbacks, it has been proposed to install an industrial robot between a casting machine and trimming press for automatic transfer of castins to the trimming press. However, application of an ordinary industrial robot sometimes led to various drawbacks that where any slight discrepancy arose in the timing in which a casting is carried by the industrial robot or the casting was brought by the robot to a point displaced from a prescribed position, then the succeeding machines failed to be properly operated, probably giving rise to the occurrence of a serious accident.

To eliminate the above-mentioned difficulties, it is necessary to use a vary reliable industrial robot of high efficiency. However, such industrial robot has the disadvantage of being extremely expensive. At present, therefore, castings are delivered from a die-casting machine to a trimming press mostly by the hand. The situation has not ripened yet for application of an industrial robot for said delivery. The above-mentioned circumstances have considerably hindered the manufacture of castings by an integral process as well as saving of manpower and centrallized control in said manufacture and the automatic operation of a die-casting plant.

SUMMARY OF THE INVENTION

It is accordingly the object of this invention to provide an automatic working method of castings which comprises the steps of connecting for automatic integral operation a die-casting machine, industrial robot, trimming press and incasing device for packing a trimmed casting in a box, where necessary; checking the operation of the above-mentioned machines to effect the smooth operation of a process extending from the casting of raw material to the trimming of a casting or to the incasing of a trimmed casting if required; immediately stopping any of the machines if it fails to be properly operated; keeping the other machines temporarily operated until the condition for their eventual stoppage is reached and finally bringing said other machines to rest.

To attain the above-mentioned object, an automatic working method of castings embodying this invention comprises the operation of a die-casting machine including the sequential steps of spraying a release agent, injecting raw material into a die-casting machine, opening a casting die, and pushing or ejecting a casting out of the die; the operation of an industrial robot including the sequential steps of restoring the industrial robot to the original position or home position, advancing or forwarding a robot arm, causing the robot arm to grip the casting for removal, retracting a moving backward the robot arm, cooling or quenching the casting and delivering or feeding the casting to the trimming press; the operation of a trimming press including the sequential steps of restoring the trimming press to the original position or home position, defining the position of a casting in the trimming press, carrying out trimming, separating the upper and lower die members, removing the casting from the trimming press and taking out scrap; checking the position of a casting set in the trimming press before trimming is undertaken; removing the casting from the trimming press if the casting is found to take an improper position in said press; examining predetermined steps to detect whether the die-casting machine, industrial robot and trimming press are respectively carrying out the above-mentioned sequential steps under a normal condition by means of checking devices attached to said machines; and, in case any of said machines is found by the checking device to present an improper operation, immediately stopping said faulty machine.

The method of this invention provides a casting-working apparatus which can automatically carry out an integral process extending from the casting of raw material to the trimming of castings without using a complicated expensive arithmetic operation device. If an incasing device is provided after the trimming press, where necessary, then it is possible to undertake an automatic integral process extending from the casting of raw material to the incasing of a trimmed casting. Further, as previously described, the sequential steps of the die-casting machine, industrial robot and trimming press can be outlined while examination is made of said predetermined steps. If, therefore, any of said three machines proves faulty, then said machine is immediately stopped, thereby preventing a disqualified product from being produced and saving said faulty machine from possible breakdown, should its operation be later forcefully continued. Under the above-mentioned condition the other machines are temporarily kept operated until eventually brought to rest due to the stoppage of said faulty machine, unless said other machines themselves break down. Where, therefore, the failure of the first mentioned faulty machine is eliminated, then the casting-working operation can be resumed smoothly and quickly, thereby effectively elevating the efficiency of a casting-working apparatus. Where control systems and data transfer systems related to the machines used with the casting-working method of this invention are concentratedly gathered in a stationary one of said machines, for example, a die-casting machine or industrial robot for connection to an external device, then it is possible easily to exchange a trimming press or incasing device for a different type according to the kind of castings being produced. This arrangement enables the casting-working apparatus to be automatically operated while monitoring data on the whole of said apparatus. If, therefore, a casting working plant comprises a plurality of casting-working apparatuses, then it is possible to effect the centralized control of said plural apparatuses or carry out the unattended operaton of the entire plant, obviously decreasing the production cost of castings. Further, if the order is changed in which the push or ejecting of castings by a die-casting machine and the grip of said castings by the arm of an industrial robot are undertaken, then it is possible to provide a process adapted to remove a thick casting from a die or withdraw a thin casting from the die after gripping the casting in advance at a prescribed position. Where the grip of a casting by the arm of an industiral robot is first undertaken, then the robot arm is so arranged as to commence the pullout of the casting at the same time as its push by the die-casting machine, thereby enabling the casting to be easily removed from the die.

DESCRIPTION OF THE PREFERRED EMBODIMENTS

Figure 1:
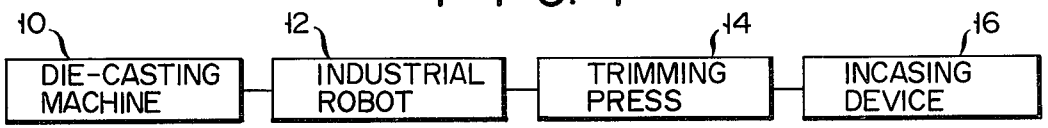
FIG. 1 shows the relative positions of four machines, used with the automatic casting-working method of this invention, that is, a die-casting machine, industrial robot, trimming press and incasing device.

FIG. 1 shows the relative positions of the machines used with the casting-working method of this invention, that is, a die-casting machine 10, industrial robot 12, trimming press 14 and incasing device 16 provided if required. A casting produced by the die-casting machine 10 is carried to the trimming press by the industrial robot 12. A casting trimmed by the trimming press 14 is packed in a box by the incasing device 16 and discharged to the outside. At this time scrap or runner refuse is separated from the trimmed casting and is taken out of the trimming press 14.

Figure 2:
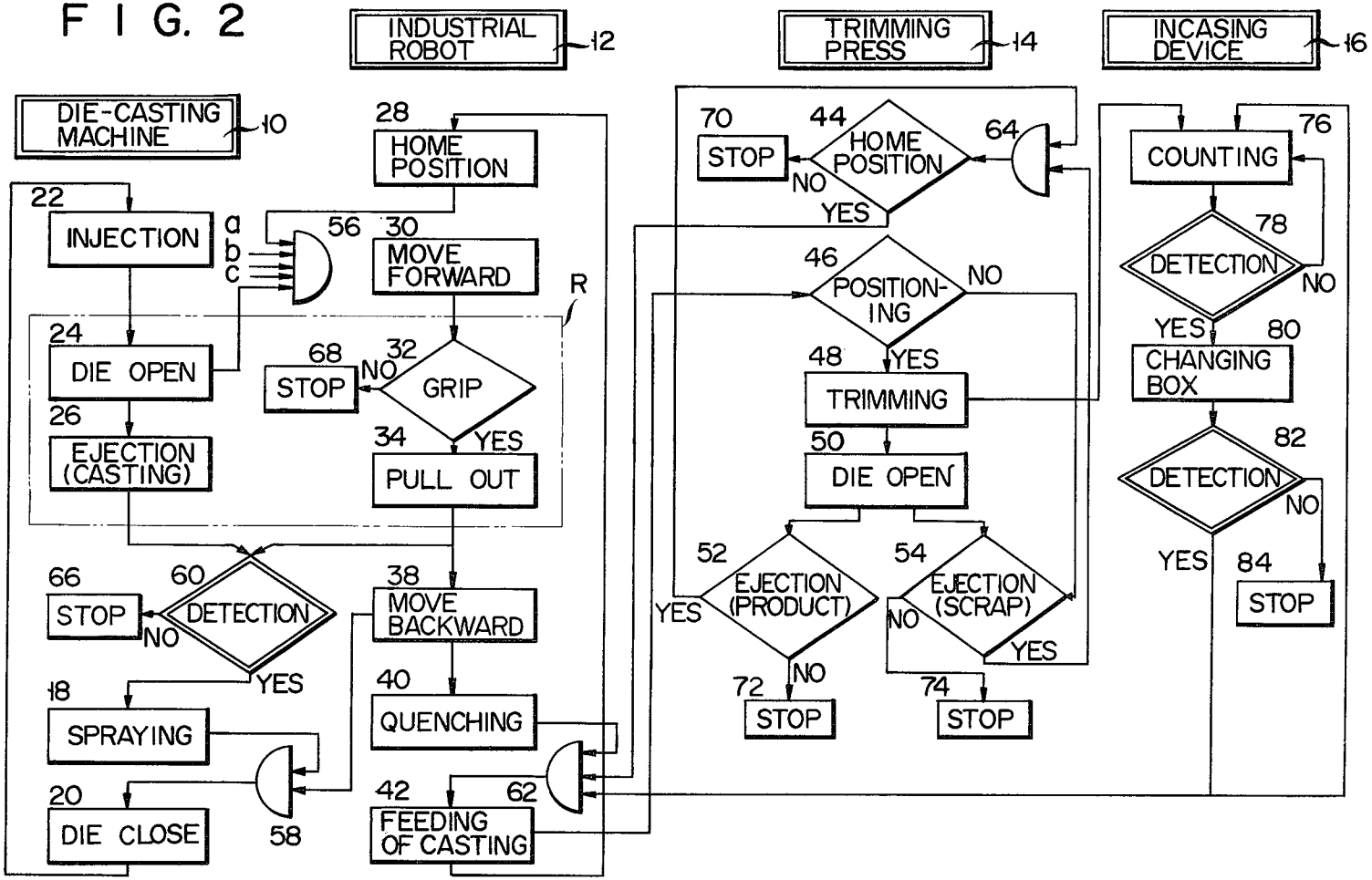
FIG. 2 is a flow diagram showing the principal steps undertaken by the respective machines of FIG. 1.

FIG. 2 is a flow diagram showing the principal steps of the respective machines with the names thereof given above the corresponding operation cycles.

A die-casting machine 10 produces various forms of castings by injecting, for example, an aluminium alloy into a die. Operation of the die-casting machine 10 comprises the step 18 of spraying a release agent into the interior of a die, the step 20 of closing a die, the step 22 of injection, the step 24 of opening the die and the step 26 of ejecting a casting out of the casting die. One cycle of operating the die-casting machine 10 is chosen to be finished in approximately 16 seconds, for example, in the case of die-casting zinc.

The industrial robot 12 draws a casting out of the die-casting machine 10 and transfers the casting to the trimming press 14 after said casting is quenched by a separate device. Operation of the industrial robot 12 includes the step 28 of restoring the robot 12 to the original position; the step 30 of advancing the arm of the robot 12 into the die-casting machine 10, the step 32 of gripping a casting by the end of the robot arm; the step 34 of pulling the gripped casting out of the die; the step 38 of retracting the robot arm from the die-casting machine 10; the step 40 of dipping the gripped casting into cooling liquid, for example, cooling water; and the step 42 of delivering the cooled casting to the trimming press 14. One cycle of carrying out all the above-listed steps included in the operation of the industrial robot 12 is chosen to be finished in the same length of time as one cycle of operating the die-casting machine 10. The reason why the step 32 of gripping a casting by the robot arm is indicated, as shown in FIG. 1, by a logenge is to show that said gripping step 32 is provided with an additional step of examining the operation of the industrial robot 12, namely, sending forth a YES or NO signal according to whether the gripping step 32 is properly carried out. A YEST signal allows the robot arm to pull out a casting gripped thereby. A NO signal admits of the commencement of the step 68 of stopping the operation of the industrial robot 12. (a logenge given hereinafter shows that a machine represented by said logenge is similarly provided with a device for detecting where or not the machine is operated under a normal condition).

The trimming press 14 trims a plurality of castings brought by the industrial robot 12 from the die-casting machine 10 in the form joined together by a runner, thereafter separates the castings by cutting off the runner and removes scrap, that is, burrs, runner refuse and any other unnecessary deposits. Operation of the trimming press 14 includes the step 44 of restoring the press 14 to the original position; the step 46 of setting the castings in a prescribed position relative to the trimming press 14; the step 48 of trimming the castings; the step 50 of opening the upper and lower press die members to separate the castings from unnecessary deposits; the steps 52 of removing the castings from the inner wall of the upper press die member and runner refuse and any other unnecessary deposits from the inner wall of the lower press die member; and the step 54 of discharging scrap from the trimming press 14. One cycle of carrying out the above-listed steps included in the operation of the trimming press 14 is chosen to be finished in the same length of time as one cycle of operating the die-casting machine 10.

The incasing device 16 packs castings delivered from the trimming press 14 in a box in a prescribed number each time, carries a packed box to the outside and feeds a fresh empty box. Operation of the incasing device 16 includes the step 76 of counting a number of trimmed castings brought from the trimming press 14 based on the trimming step 48 of said press 14; the step 78 of detecting whether or not the counted number has reached a prescribed value and issuing a YES or NO signal according to whether or not the counted number indicates the prescribed value; the step 80 of feeding a fresh empty box where a YES signal is emitted from a device undertaking the step 78 and exchanging a fully packed box for the fresh empty box; and the step 82 of detecting whether the time of exchanging a packed box for an empty box by the step 80 falls with a prescribed range and sending forth a YES or NO signal according to whether or not said exchange time lies within the prescribed range. One cycle of carrying out the above-mentioned steps included in the operation of the incasing device 16 is chosen to be finished in the same length of time as one cycle of operating the die-casting machine 10. The reason why the steps 78, 82 are respectively represented by a double lozenge is to show that said steps 78, 82 carry out only detection which is not directly related to the working of castings. The steps 60 of detecting the withdrawal of a casting from the casting die, detects whether the step 26 of ejecting a casting out of a casting die by the die-casting machine 10 and the step 34 of pulling out a casting from a casting die by the industrial robot 12 are both accompolished or not and is enclosed in a double lozenge.

AND gates 56, 58 are provided between the die-casting machine 10 and robot 12. The AND gate 56 issues an output signal when five conditions are all met, namely, that the step of opening a casting die by the casting machine 10 has been brought to an end; the casting machine 10 is not formed of a manually operated circuit but a fully automated circuit (as shown *a*); a casting is still received in the casting die of the casting machine 10 (as shown *b*); one cycle of operating the casting machine 10 has been finished in a prescribed length of time without occurrence of any abnormal condition (as shown *c*); and the step 28 of restoring the industrial robot 12 to the original position has been completed. An output signal from the AND gate 56 allows the step 30 of advancing the arm of the industrial robot 12. The requisite conditions for issue of an output from the AND gate 56 are not limited to the above-mentioned five requirements, but may be varied with, for example, the kind of castings, the type of machinery used and the manner in which different steps are combined. For example, where the AND gate 56 is designed to send forth an output when two conditions are fully met, that is, the step 24 of opening the casting die of the casting machine 10 and the step 28 of restoring the industrial robot 12 to the original position are satisfactorily finished, then the arrangement of a control circuit will be rendered much simpler due to a decrease in a number of requirements for issue of an output from the AND gate 56. The AND gate 58 generates an output on condition that the step 18 of spraying a release agent into the casting die of the die-casting machine 10 and the step 38 of retracting the robot arm are brought to an end. An output from the AND gate 58 admits of commencement of the step 20 of closing the casting die of the die-casting machine 10.

The step 60 of detecting the pullout of a casting from the casting die of the die-casting machine 10 issues a YES signal when the step 26 of ejecting a casting from the casting die and the step 34 of pulling out of the casting therefrom are fully finished, thereby admitting of the step 18 of spraying a release agent into the casting die of the casting machine 10. Where the above-mentioned two requisite conditions are not met, the device of undertaking the step 60 produces a NO signal to commence the step 66 of stopping the operation of the die-casting machine 10.

An AND gate 62 generates an output when three conditions are met, namely, when the step 40 of quenching a gripped casting is finished, a YES signal from a device undertaking the step 44 of restoring the trimming press 14 to the original position is received, and a YES signal from a device undertaking the step 82 of detecting time required to exchange a fully packed box for a fresh empty box arrives, thereby admitting of the commencement of the step 42 of delivering the cooled casting to the trimming press 14. When the step 42 is started, then the step 28 of restoring the industrial robot to the original position and the step 46 of setting the castings in a prescribed position relative to the trimming press 14 are undertaken.

The step 44 of restoring the trimming press 14 to the original position is carried out upon receipt of an output issued from an AND gate 64 when supplied with two YES signals. A YES signal from a device undertaking the step 44 is conducted to the AND gate 62. A NO signal from said device is transmitted to a device undertaking the step 70 of stopping the trimming press 14, thereby stopping said press 14. The AND gate 64 generates an output when two conditions are met, namely, when a device undertaking the step 52 of removing trimmed castings from the inner wall of the upper press die member and a device carrying out the step 54 of discharging scrap from the inner wall of the lower press die member give forth a YES signal alike. The step 46 of setting the castings in a prescribed position relative to the trimming press 14 is commenced when the step 42 of delivering the cooled castings to the trimming press 14 is brought to an end. A YES signal from a device carying out the step 42 allows the step 48 of trimming the castings. A NO signal from said device admits of the step 54 of discharging scrap from the trimming press 14. At this time, improperly set castings are taken out of the trimming press 14. A NO signal issued from a device carrying out the step 52 of removing castings from the inner wall of the upper press die member is transmitted to a device undertaking the step 72 of stopping the trimming press 14, thereby stopping the operation of said press 14. A NO signal from a device carrying out the step 54 of discharging scrap is sent forth to a device undertaking the step 74 of stopping the trimming press 14, thereby stopping the operation of said press 14.

Where a device carrying out the step 44 of restoring the trimming press 14 to the original position issues a NO signal and a YES signal is not received, then the AND gate 62 generates no output. Normally, the industrial robot 12 ceases to be operated when the step 40 of quenching gripped castings.

The product-counting step 76 undertaken by the incasing device 16 is commenced when three conditions are met, namely, when a signal denoting the end of the step 48 of trimming castings by the trimming press 14 is received, a device undertaking the step 78 of detecting a number of trimmed castings issues a NO signal to denote that the counted number has not reached a prescribed value and a device carrying out the step 82 of detecting time required to exchange a filled box for a fresh empty box sends forth a YES signal. A NO signal from the device carrying out the step 82 is delivered to a device undertaking the step 84 of stopping the incasing device 16. A YES signal from the device carrying out the above-mentioned step 82 is supplied to the AND gate 62 and a device carrying out the step 76 of counting trimmed castings. Where the incasing device 16 issues a NO signal and a YES signal is received, then the AND gate 62 does not send forth an output, thereby stopping the step 42 of delivering the cooled castings by the trimming press 14. Therefore the step 28 of restoring the industrial robot 12 to the original position and the step 46 of setting castings in a prescribed position relative to the trimming press 14, both of which are started by said output from the device undertaking the step 42 are not put into operation. As the result, the industrial robot 12 trimming press 14 cease to be operated.

There will now be described the automatic working method of castings according to the above-mentioned embodiment of this invention.

Referring to FIG. 2, where the step 18 of spraying a releasing agent into the casting die of the die-casting machine 10 and the step 38 of retracting the arm of the industrial robot 12 are brought to an end, then an output from the AND gate 58 commences in turn the step 20 of closing the casting die of the die-casting machine 10, the raw material-injecting step 22 started in a prescribed time $t_1$ after completion of the step 20 and the casting die-opening step 24 started in a prescribed time $t_2$ after completion of the step 22. The step 26 of ejecting a casting out of a casting die is carried out after the casting die is opened by the step 24. Where the previously described five requisite conditions are fully met, then the step 30 of advancing the robot arm, the succeeding step 32 of gripping an ejected casting by the robot arm and the step 34 of pulling out the casting by said robot arm are undertaken. Where the aforesaid five conditions are not satisfied, then the industrial robot 12 does not carry out the step 30 of advancing its arm, but stands at rest in the original position. Where a device undertaking the step 32 of gripping a casting sends forth a NO signal, then the step 68 of stopping the operation of the industrial robot 12 is commenced, thereby terminating its operation. A YES signal from the device undertaking the step 32 of gripping a casting causes the step 34 of pulling out a casting from the casting die of the die-casting machine 10, the step 38 of retracting the robot arm and the step 40 of quenching a gripped casting to be carried out in succession. A device carrying out the step 60 of detecting the withdrawal of a casting from the casting die produces a YES signal when the step 26 of ejecting a casting out of the casting die and the step 34 of pulling out the casting by the robot arm are brought to an end, causing the release agent-spraying step 18 to be commenced. A NO signal from the device carrying out the step 60 which is sent forth when the steps 26, 34 are not finished causes the casting machine 10 to carry out the step 66 of stopping the withdrawal of a casting from the casting die. Where the release agent-spraying step 18 and the robot arm-retracting step 38 are finished, the AND gate 58 gives forth an output, which causes the die-closing step 20 to be commenced, and in consequence the casting machine 10 to repeat a normal casting operation.

The step 40 of quenching a casting by the industrial robot 12 is effected by the rotation, advance and vertical movement of the robot arm and various movements of the end portion of the robot arm. Where the quenching step 40 is completed, the trimming press 14 regains its original position, and exchange of a packed box for an empty box by the incasing device 16 is finished in a prescribed length of time, then the AND gate 62 issues an output signal, which causes the step 42 of delivering castings to the trimming press 14 to be started. One of two outputs generated by a device undertaking the step 42 when said step is brought to an end causes the step 28 of restoring the industrial robot 12 to the original position to be commenced. The industrial robot 12 row set in the original position is rendered ready for the succeeding cycle of operation.

Where the devices carrying out the step 52 of removing castings from the inner wall of the upper press die member and the step 54 of discharging scrap from the trimming press 14 issue a YES signal alike, then the trimming press 14 regains its original position by the step 44 upon receipt of an output from the AND gate 64. A NO signal from the device carrying out the step 44 causes the operation of the trimming press 12 to be stopped by the step 70. Where the device undertaking the step 44 sends forth a YES signal and the other two requisite conditions for operation of the AND gate 62 are met, then a casting is conducted to the trimming press 14 by the step 42, followed by the step 46 of setting a casting in a prescribed position relative to the trimming press 14 and the step 28 of restoring the industrial robot 12 to its original position. Up to this point, the casting machine 10 already carries out the releasing agent-spraying step 18, casting die-closing step 20 and raw material-injecting step 22 all belonging to the succeeding cycle of operation. Where the requisite conditions for operation of the AND gate 62 are not satisfied, then the devices undertaking the step 42 of supplying a casting to the trimming press 14 and the step 46 of setting a casting in a prescribed position relative to the trimming press 14 cease to be operated. Nor is carried out the step 28 of restoring the industrial robot 12 to its original position.

Where, with the trimming press 14, the step 46 of properly setting a casting is brought to an end and said proper setting is detected, then a YES signal from the device undertaking the step 46 causes the step 48 of trimming a casting to be commenced. Where a casting is not properly set in the trimming press 14, then the device carrying out the step 46 issues a NO signal, which causes the step 54 of discharging scrap to be commenced. At this time, a casting is temporarily taken out of the trimming press.

Where the step 48 of trimming a casting is finished, then the step 50 of separating the upper and lower press die members takes place. At this time, a trimmed casting still remains attached to the inner wall of the upper press die member, and scrap is left on the inner wall of the lower press die member. First, the step 52 takes place to remove a trimmed casting, the step 54 of removing scrap from the lower press die member is preferred to take place a little later than the step 52. The reason is that it is desired to prevent a large load from being otherwise applied at once to a power source which is used to operate both steps 52, 54. Where the steps 52, 54 are carried out properly, and the devices undertaking the step 52, 54 send forth a YES signal alike to the AND gate 64, then an output from the AND gate 64 restores the trimming press 14 to its original position. The step 52 of removing a trimmed casting from the inner wall of the upper press die member is carried out together with, for example, the spray of compressed air for elimination of burrs, as well as with the shifting of a trimmed casting receptacle to a proper position. Where either or both of the devices carrying out the steps 52, 54 issue a NO signal, then either or both of the corresponding stop steps 72, 74 is commenced to terminate the operation of the trimming press 14. Since, at this time, requisite conditions for operation of the AND gate 64 are not met, the step 44 of restoring the trimming press 14 to its original position is not commenced.

During the period extending from the step 46 of setting a casting in a proper position relative to the trimming press 14 to the step 44 of restoring the trimming press 14 to its original position, the casting machine 10 carries out the step 24 of opening the casting die and the step 26 of ejecting a casting from the casting die belonging to the succeeding cycle of operation. The industrial robot 12 performs the step 30 of advancing its arm and the step 32 of gripping a casting by said arm. Where a device carrying out the step 78 of detecting a counted number of trimmed castings issues a NO signal denoting that said counted number does not indicate a prescribed value and a device carrying out the step 82 of detecting a time required to exchange a packed box for an empty box sends forth a YES signal, then the incasing device 16 undertakes the product-counting step 76 upon receipt of an output from a device belonging to the trimming press 14 which undertakes the trimming step 48. Where the counted number of trimmed castings reaches a prescribed value, and a device undertaking the step 78 of detecting a counted number of trimmed castings generates a YES signal, then said YES signal causes the step 80 of exchanging a packed box for an empty box to be carried out. Where a time required for said exchange falls outside of a prescribed range and a device carrying out the step 82 of detecting the time of exchange generates a NO signal, namely, where said exchange is not carried out smoothly but takes a longer time than prescribe due to some difficulties, then the incasing device 16 is stopped by the step 84. Where a device carrying out the step 82 of detecting the time of exchange issues a YES signal, then the associated steps are performed as previously described.

Where any of the casting machine 10, industrial robot 12, trimming press 14 and incasing device 16 constituting the automatic working method of castings embodying this invention fails, then said faulty machine is immediately brought to rest. In this case, the other machines are temporarily kept operated until they are eventually brought to rest due to the stoppage of the first mentioned defective machine, unless they break down due to their own failure.

For example, where the industrial robot 12 fails to carry out the step 32 of gripping a casting by its arm, then the industrial robot 12 is immediately stopped by the step 68. In this case, however, the trimming press 14 still continues to carry out the step 52 of removing a casting trimmed in the preceding cycle, the step 54 of discharging runner refuse and any other unnecessary deposits and the steps (not shown) of throwing off burns by spraying compressed air and remains operated until the step 44 of restoring the trimming press 14 to its original position is brought to an end, unless the press 14 itself breaks down. The press 14 is eventually brought to rest while sending forth a YES signal to one of the three input terminals of the AND gate 62. At this time, the incasing device 16 carries out the step 80 of exchanging a packed box for an empty box, provided all the requisite conditions are met. After the trimming press 14 is eventually brought to rest, castings are not supplied from said press 14, and in consequence the step 76 of counting a number of trimmed castings does not take place. Thus, the incasing device 16 is stopped in a state prevented from counting trimmed castings.

The casting machine 10 is supplied with a NO signal from a device carrying out the step 60 of detecting the withdrawal of a casting from the casting die, because the step 32 of gripping a casting by the robot arm does not take place. Therefore, the casting machine 10 is stopped by the step 66.

Where, with the trimming press 14, the step 44 of restoring said trimming press 14 to its original position, the step 52 of removing a trimmed casting from the inner wall of the upper press die member and the step 54 of discharging scrap do not take place, then the trimming press 14 is instantly stopped by the steps 70, 72, 74. However, the casting machine 10, the industrial robot 12 and incasing device 16 are kept operated until they are eventually brought to rest due to the stoppage of the first mentioned defective machine, unless they break down due to their own failure.

Where, in any of the above-mentioned cases, a cause for stopping any of the machines used with the casting-working method of this invention is eliminated and the machines are operated again, then no casting or trimmed casting is left in an intermediate step of the respective machines, thereby enabling these machines to be restarted smoothly in a short time.

Where the step 46 of setting castings in a trimming press 14 is carried out improperly, then the step 48 of trimming castings is not conducted, but the step 54 of discharging scrap is immediately commenced. Therefore, it is possible to avoid the failure of trimming due to the imperfect execution of the casting-setting step 46 and the stoppage or breakdown of the trimming press 14 which would arise from said failure of trimming.

Figure 3:
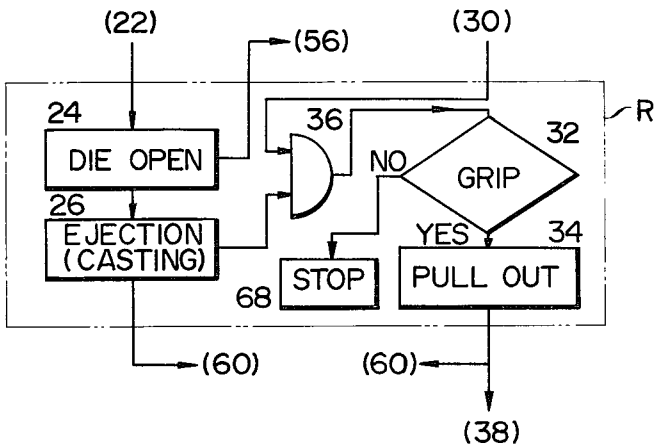
FIG. 3 is a modification of the flow diagram of FIG. 1 in which the push of a casting is carried out ahead of the grip thereof.

FIG. 3 is a fractional flow diagram of a modification of the casting-working method of this invention from that of FIG. 2, in which the step 26 of ejecting a casting out of a casting die is carried out after the step 24 of opening the casting die, and the step 32 of gripping a casting by the arm of the industrial robot 12 is undertaken after the step 30 of advancing the robot arm and the step 26 of ejecting the casting out of the casting die. The arrangement of FIG. 3 is used in place of the section R of FIG. 2 which is enclosed in dot-dash lines. The modification of FIG. 3 comprises an AND gate 36 which issues an output when the step 26 of ejecting a casting from a casting die and the step 30 of advancing a robot arm are brought to an end. Upon receipt of an output from the AND gate 36, the step 32 of gripping a casting by the robot arm is commenced. The other functions of FIG. 3 are the same as those of FIG. 2. The modification of FIG. 3 is adapted to take out a thick casting lying deep in a casting die or pull out a casting from a casting die without the necessity of gripping the casting by the robot arm in an exactly defined position. The advantage of the modification of FIG. 3 lies in the fact that where a casting is pulled out of a casting die by being gripped by the end portion of a robot arm, the robot arm generally has to be swung to a certain extent; and consequently the casting held by the robot arm is also swung relative to the opening of the casting die, presenting difficulties in pulling out the casting from the casting die or in some cases making impossible said pullout operation. According to the modification of FIG. 3, the withdrawal of a casting is carried out mostly by the step 26 of ejecting the casting. The step 34 of pulling out the casting by the robot arm is undertaken only in taking out that portion of the casting which is retained in the casting die up to the last time of the withdrawal operation. Therefore, the modification of FIG. 3 enables the operation of the casting machine 10 and industrial robot 12 to be easily controlled.

Figure 4:
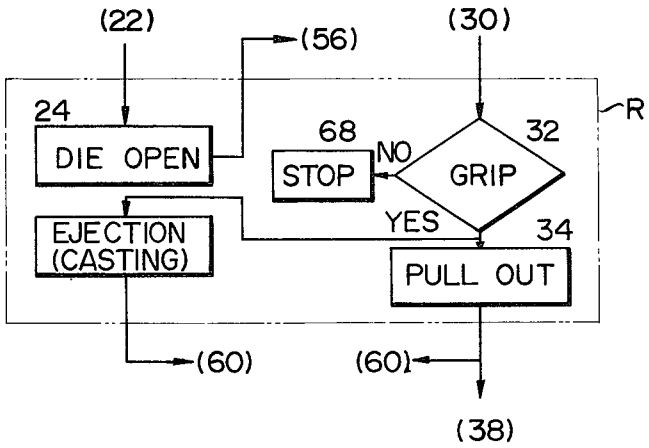
FIG. 4 is a modification of the flow diagram of FIG. 2 in which the grip of a casting is carried out ahead of the ejection thereof.

FIG. 4 is a fractional flow diagram of a modification of the casting-working method of this invention from that of FIG. 2, in which a casting is first gripped and then pushed out of a casting die. The modification of FIG. 4 is used in place of the section R of FIG. 2 which is enclosed in dot-dash lines. The other functions of FIG. 4 are the same as those of FIG. 2. According to the flow diagram of FIG. 4, the step 30 of advancing the arm of the industrial robot 12 is carried out after the step 24 of opening a casting die. After a casting still received in a casting die is gripped, the step 26 of ejecting the casting by the casting machine 10 and the step 34 of pulling out the casting by the arm of the industrial robot 12 take place at the same time. According to the modification of FIG. 4, a casting is gripped while taking a fixed position, that is, while being received in a casting die. Namely, when gripped by the arm of the industrial robot 12, each casting takes the same position and posture, thereby effectively elevating the precision with which the casting is trimmed. The modification of FIG. 4 in which a casting is first gripped is adapted to take out a relatively thin casting from a consequently shallow die opening for the same reason given with respect to the modification of FIG. 3.

In the case of the modification of FIG. 4, the following three processes are selectively used in withdrawing a casting from a casting die. The first process is to carry out the step 26 of ejecting a casting from a casting die with the arm of the industrial robot 12 left free instead of being moved. In this case, the robot arm which grips the casting is moved outward according as the casting is ejected from the casting die by the casting machine 10 finally to remove the casting from the casting die. The second process is to move the robot arm to assist the step 26 of ejecting the casting from the casting die by the casting machine 10, thereby effecting the smooth withdrawal of the casting. The third process is to move the robot arm only in the initial stage of ejecting the casting from the casting die by the casting machine 10 to assist the free release of the casting from the casting die and later pull out the casting with the robot arm left free instead of being shifted. The first process is adapted for the case where the casting can be easily taken out of the casting die. The second is adapted for process is effective in the case where a strong force should be applied all the time in the withdrawal of the casting. The third process proves useful in the case where a strong force is required in the initial stage of taking out the casting, but a small force well serves the purpose in the later stage of removal.

Figure 5:
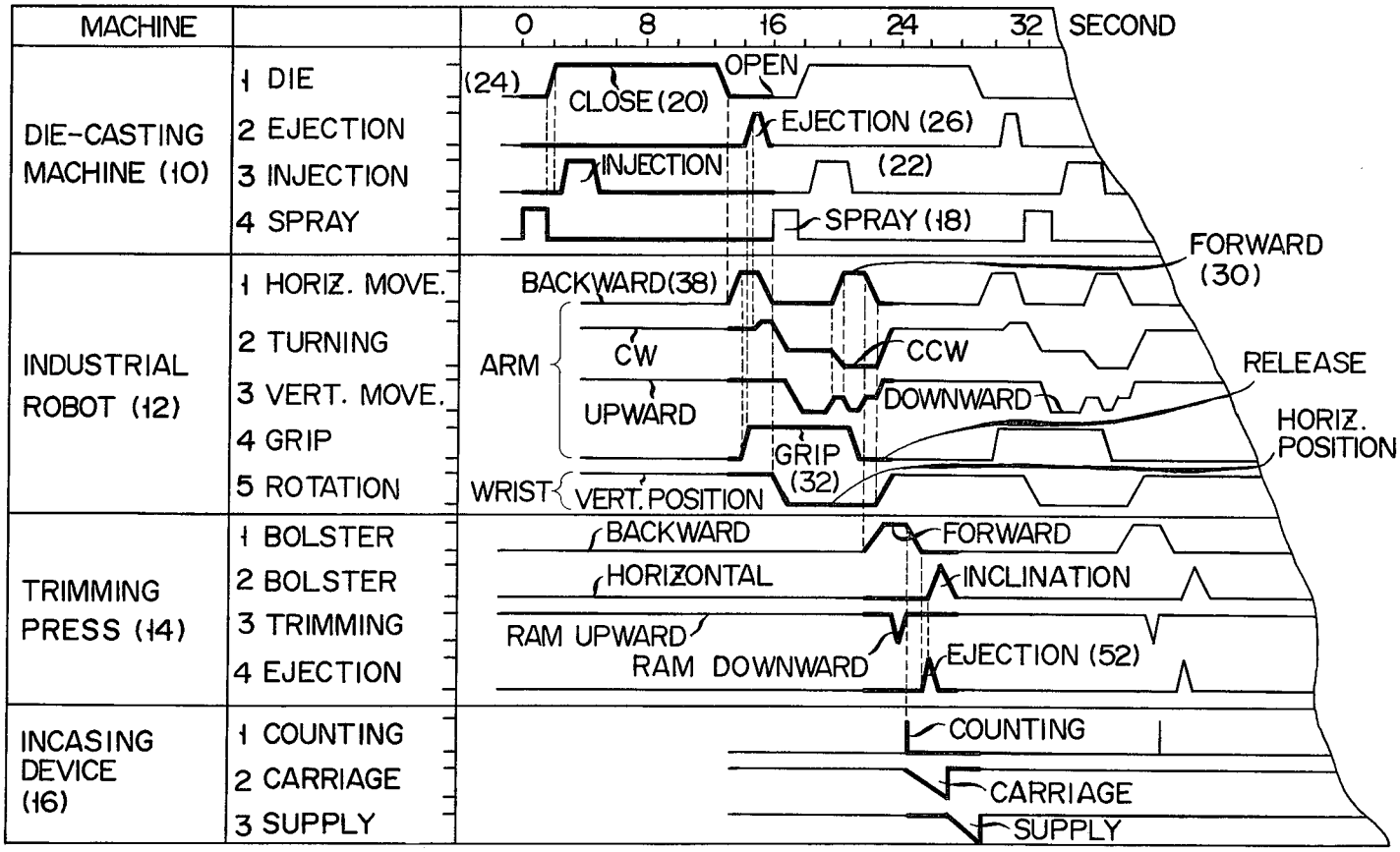
FIG. 5 is a time chart of the principal steps of the die-casting machine, industrial robot and trimming press.

FIG. 5 is a time chart showing the time sequence of the principal steps indicated in the flow diagram of FIG. 4. The lengths of time required for all the machines to be started, restored to the original position and then commenced the succeeding cycle of operation are chosen to be, for example, 16 minutes. This operating period is primarily defined by the performance of the casting machine 10. The periods in which the industrial robot 12, trimming press 14 and incasing device 16 start operation and regain the original position are shorter in the increasing order then the period in which the casting machine 10 is started and then restored to the original position. This is because the industrial robot 12, trimming press 14 and incasing device 16 finish their respective cycles of operation in a shorter time then the casting machine 10. These three other machines than the casting machine 10 remain in operative in a state ready for the succeeding cycle of operation until a sufficient length of time passes after they are restored to the original position to correspond to a total of 16 seconds as counted from the point of time at which they commence operation. FIG. 5 illustrates in time sequence the lengths of time required for the casting machine 10 to finish the corresponding cycle of operation and also for the other machines, that is, the industrial robot 12, trimming press 14 and incasing device 16 to treat a casting produced. The periods in which the three other machines 12, 14, 16 do not actually treat the casting, that is, the periods in which they simply present an idle operation are indicated in straight lines. The sections shown in broad lines represent the lengths of time required for all the four machines 10, 12, 14, 16 to be restored to the original position after they commence operation.

As seen in FIG. 5, the step 18 of spraying a release agent, the step 20 of closing a casting die, the step 22 of injecting raw material into the casting die and the step 24 of opening the casting die are conducted in succession. The step 24 of opening the casting die is carried out after a sufficient time passes for solidification of a casting. When the casting die is opened by the step 24, the industrial robot 12 advances (the step 30) to grip the casting (the step 32) by its arm. The step 26 of ejecting the casting from the casting die by the casting machine 10 is carried out substantially at the same time as the step 32 of sripping the casting by the robot arm. Referring to the section of FIG. 5 denoting the cycle of operation of the industrial robot 12, lines 2, 3, 5 are related to the step 40 of quenching a casting and the step 42 of delivering the casting to the trimming press 14. After the step 42 is brought to an end, the step 48 of trimming the casting is carried out by the vertical movement of a ram. The steps belonging to the cycle of operation of the incasing device 16 which are indicated in FIG. 5 are the discharge of a packed box and the supply of an empty box included in the step 80 of exchanging a packed box for an empty box. The above-mentioned steps are undertaken in the order indicated in FIG. 5, any further description being omitted.

The automatic working method of castings embodying this invention which have been described by reference to the foregoing embodiments have the following advantages that it is possible to provide an apparatus capable of automatically carrying out an integral operation extending from the production of a casting to the trimming or incasing thereof; since the devices undertaking the important steps of the respective machines used with the casting-working method of this invention are each provided with an operation-detecting device, the machine which fails properly to carry out any of the important steps is immediately stopped to admit of repairs, thereby ensuring a reliable and safe operation; the other machines than a defective one which has been stopped still remain operated until they are eventually brought to rest due to the breakdown of said defective machine, thereby enabling the succeeding cycle of operation to be commenced again easily with the resultant elevation of working efficiency; control system associated with the casting machine 10, trimming press 14 and incasing device 16 and other system of transferring data on the respective steps are generally concentrated in a machine fixed in a prescribed position such as the casting machine 10 or industrial robot 12 and when connected to various external devices, said concentrated systems enable the trimming press 14 and incasing device 16 to be easily exchanged for different types according to the kind of castings being produced, thereby broadening the range in which the casting-working apparatus is applied; where a plant comprises a plurality of such casting-working apparatuses it is possible to carry out the centralized monitoring and control of said apparatuses and further realize the unattended operation of the plant; a thick casting can be removed from a casting machine by the modification of FIG. 3 of the casting-working method shown in FIG. 2; a thin casting can be removed therefrom by gripping said casting by the arm of the industrial robot 12, and can be removed easily by suitably shifting the robot arm to assist the ejection of the casting by the casting machine 10; where a casting fails to be set in a prescribed position relative to the trimming press 14, then the casting is immediately taken out, thereby avoiding the production of a disqualified casting or the breakdown of the trimming press 14, should the trimming of the improperly positioned casting be forecefully continued.

I claim:

1. An automatic working method of castings which comprises the operation of a casting machine including the steps of spraying a release agent, injecting raw material into a casting die, opening the casting die, and ejecting a casting from the casting die; the operation of an industrial robot having an arm restoring said robot to its original position, advancing the robot arm, gripping the casting by the robot arm, pulling out the casting from the casting die by the robot arm, retracting the robot arm, quenching the casting, and transferring the quenched casting to the succeeding trimming press; the operation of the trimming press including restoring the press to its original position, setting the casting in a prescribed position relative to the trimming press, separating the upper and lower press die members, removing the trimmed casting from the trimming press and discharging scrap from the trimming press; detecting whether the casting is properly set in the trimming press for trimming; removing the casting from the trimming press without trimming, in case the casting fails to be properly set; detecting whether the casting machine, industrial robot and trimming press are carrying out the prescribed steps under a normal condition; and immediately stopping the machine which has been found by the detecting step to present a failure to perform any of the prescribed steps included in the operation of said machine.

2. The automatic working method of castings according to claim 1, wherein the detection steps include detecting the gripping of a casting by the arm of the industrial robot; detecting whether the step of ejecting the casting from a casting die by the casting machine and the step of pulling out the casting by the robot arm have been brought to an end; detecting whether the trimming press has been restored to its original position; detecting whether the casting has been properly set in the trimming press; detecting whether the casting has been removed from the trimming press; and detecting whether scrap has been discharged from the trimming press.

3. The automatic working method of castings according to claim 1, wherein ejecting a casting by the casting machine and gripping the casting by the arm of the industrial robot are undertaken after opening of a casting die by the casting machine.

4. The automatic working method of castings according to claim 2, wherein gripping a casting by the arm of the industrial robot is carried out after ejecting of the casting from a casting die by the casting machine.

5. The automatic working method of castings according to claim 2, wherein gripping a casting by the arm of the industrial robot is carried out before ejecting of the casting from a casting die by the casting machine.

6. The automatic working method of castings according to claim 5, wherein a casting is ejected from a casting die by the casting machine with the arm of the industrial robot left free instead of being moved.

7. The automatic working method of castings according to claim 5, comprising moving the arm of the industrial robot all the time to assist in ejecting a casting from a casting die by the casting machine.

8. The automatic working method of castings according to claim 5, comprising moving the arm of the industrial robot to assist only in the initial stage of ejecting a casting from a casting die by the casting machine.

9. The automatic working method of castings according to claim 1, which further comprises counting a number of trimmed castings delivered from the trimming press; exchanging a box packed with trimmed castings for an empty box, where the counted number of trimmed castings indicates a prescribed value; where the counted number of trimmed castings does not reach a prescribed value, the step of detecting a deficient number and supplying trimmed castings corresponding to said deficient number; and detecting a length of time required to exchange a packed box for an empty box, and, in case the exchange is not finished in a prescribed length of time, sending forth a signal to stop any succeeding exchange.

10. The automatic working method of castings according to claim 9, wherein the detection steps include detecting the gripping of a casting by the arm of the industrial robot; the step of detecting whether ejecting the casting from a casting die by the casting machine and the step of pulling out the casting by the robot arm have been brought to an end; detecting whether the trimming press has been restored to its original position; detecting whether the casting has been properly set in the trimming press; detecting whether the casting has been removed from the trimming press; and detecting whether scrap has been discharged from the trimming press.

11. The automatic working method of castings according to claim 9, wherein ejecting of a casting by the casting machine and gripping the casting by the arm of the industrial robot are undertaken after opening of a casting die by the casting machine.

12. The automatic working method of castings according to claim 10, wherein gripping a casting by the arm of the industrial robot is carried out after ejecting of the casting from a casting die by the casting machine.

13. The automatic working method of castings according to claim 10 wherein gripping a casting by the arm of the industrial robot is carried out before ejecting of the casting from a casting die by the casting machine.

14. The automatic working method of castings according to claim 13, wherein a casting is ejected from a casting die by the casting machine with the arm of the industrial robot left free instead of being moved.

15. The automatic working method of castings according to claim 14, comprising moving the arm of the industrial robot all the time to assist in ejecting a casting from a casting die by the casting machine.

* * * * *

UNITED STATES PATENT AND TRADEMARK OFFICE

CERTIFICATE OF CORRECTION

PATENT NO. : 4,094,055

DATED : June 13, 1978

INVENTOR(S) : Toshiki MORIMOTO

It is certified that error appears in the above-identified patent and that said Letters Patent are hereby corrected as shown below:

Column 13, line 1, after "having an arm" insert

--including--;

line 37, after "wherein ejecting" insert

--of--.

Signed and Sealed this

*Thirteenth* Day of *February 1979*

[SEAL]

*Attest:*

RUTH C. MASON
*Attesting Officer*

DONALD W. BANNER
*Commissioner of Patents and Trademarks*